United States Patent [19]

Fish et al.

[11] Patent Number: 4,640,110

[45] Date of Patent: Feb. 3, 1987

[54] AUTOMATIC DELAY RELOCKING DEVICE

[75] Inventors: Aaron M. Fish, Rocky Mount, N.C.; Stanley S. Mazoff, Dollard des Ormeaux, Canada; Adamo M. D'Intino, Riviere-des-Prairies, Canada; Hariharan Somasundaram, Montreal, Canada

[73] Assignee: Ilco Unican Corp., Rocky Mount, N.C.

[21] Appl. No.: 776,626

[22] Filed: Sep. 16, 1985

[51] Int. Cl.[4] ..... E05B 43/00; E05B 13/10

[52] U.S. Cl. ..... 70/269; 70/214

[58] Field of Search ..... 70/214, 220, 267–269, 70/271

[56] References Cited

U.S. PATENT DOCUMENTS 2,079,702 5/1937 Diesel ..... 70/269

3,702,551 11/1972 Blizard ..... 70/269

3,747,377 7/1973 Van Deudekom ..... 70/220 X 3,800,572 4/1974 Beharelle ..... 70/267 X

FOREIGN PATENT DOCUMENTS 2129865 4/1984 United Kingdom ..... 70/267

*Primary Examiner*—Robert L. Wolfe

*Assistant Examiner*—Russell W. Illich

*Attorney, Agent, or Firm*—Ira M. Jones

[57] ABSTRACT

A permutation lock having pushbutton code controls and automatic cancelling of the code when the latch is operated for opening the door. An adjustable time-delay device is provided for disabling the operation of the lock after a predetermined time from when the code is inserted in the lock chamber. The time delay device disables the lock after the duration of a predetermined time.

10 Claims, 10 Drawing Figures

AUTOMATIC DELAY RELOCKING DEVICE

This invention relates to a permutation lock and, more particularly, to an adjustable time delay device for preventing unlocking of the lock after a predetermined time from inserting the code in the permutation lock.

Pushbutton mechanical locks are available in the market today. These locks, however, have a drawback in that there is no automatic relocking feature with time delay. For example, an authorized person wishing to open the door enters the correct code. For some reason or other, if he has to leave without opening the door, or someone else opens the door for him on the inside of the building, the code remains in the lock. There is no automatic feature available mechanically to decode or relock the lock. In such cases, any unauthorized person can open the door not knowing the secret code, by simply actuating the knob or handle.

The invention detailed below allows the opening of the lock for a selected period of time when the door knob is turned and the correct code is inserted. If the lock is not opened within the duration of the selected time, the lock automatically disables the opening mechanism of the lock, eliminating the possibility of unauthorized entry.

U.S. Pat. No. 3,747,377 to Van Deudekom, shows a permutation lock with a pushbutton control for the lock chamber and doorknobs on the inside and on the outside of the door to operate the latch. A linkage connects the lock chamber with a clutch of the doorknob to control the operation of the lock. This patent shows a conventional lock in which there is no means for automatically cancelling the code in the lock chamber if the door were opened from the inside of the building when the code was inserted. Accordingly, the applicant has provided for an adjustable time delay which will automatically disable operation of the lock if the door is not opened from the outside within a predetermined time.

It is an object of the invention to provide a time-delay device on a permutation lock for disabling operation of the lock a predetermined time after entry of the code in the lock chamber, and if the lock has not been operated.

It is another object of this invention to provide a delayed relocking device on a permutation lock disabling operation of the lock a predetermined time after entry of the code if the lock has not been operated.

It is a further object of this invention to provide a delayed relocking device on a permutation lock operating a micro-switch monitoring the operation or attempted operation of the lock and providing a signal at some remote location of the attempted opening of the lock.

The objects of this invention are accomplished by a permutation combination lock with pushbutton chamber control for entering of the code. The latch operator is provided for selectively unlatching the latch when the code is entered in the lock chamber. A delayed relocking device on the permutation lock operates in conjunction with the latch operator to disable operation of the lock after a predetermined time has lapsed subsequent to the entry of the code in the lock chamber. This prevents unauthorized entry by a person even though the code is entered in the lock chamber. In order to place the delayed relocking device in an opening node, which is done by rotating the latch, a linkage scrambles or cancels any code on the permutation lock chamber and thereby requires reentry of the code before opening of the lock.

Referring to the drawings:

FIG. 8 is a cross section view showing the linkage and clutch in the operating position, as shown in FIG. 4, for the scrambling of the code in the lock chamber and resetting of the delayed relocking device;

FIG. 9 is a cross section view with the linkage in a position similar to that as shown in FIG. 3.

Figure 1:
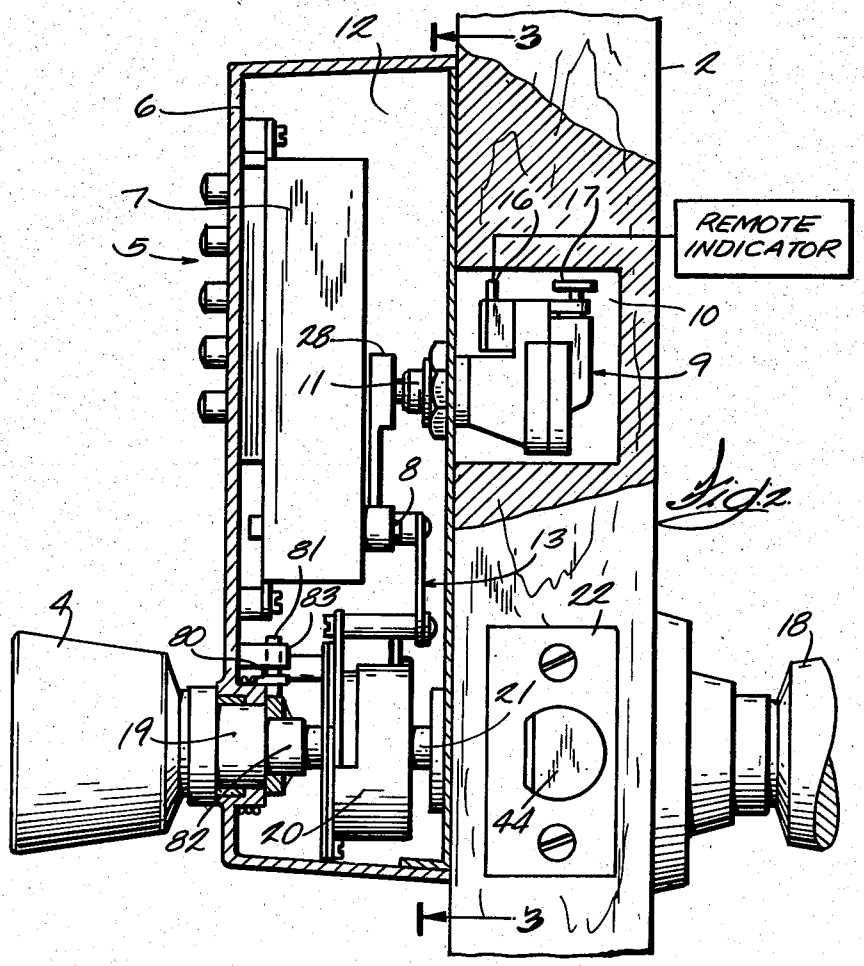
FIG. 1 illustrates a front elevation view of the permutation lock and lock chamber.

Referring to the drawings, FIG. 1 illustrates the permutation lock 1 on a door 2, an outside door knob 4 and the inside doorknob 18. The latch element 44 is in the extended position for engaging a stop in the plate 22. The pushbuttons 5 are provided for inserting the code in the lock chamber which is immediately behind the panel 6.

Figure 2:
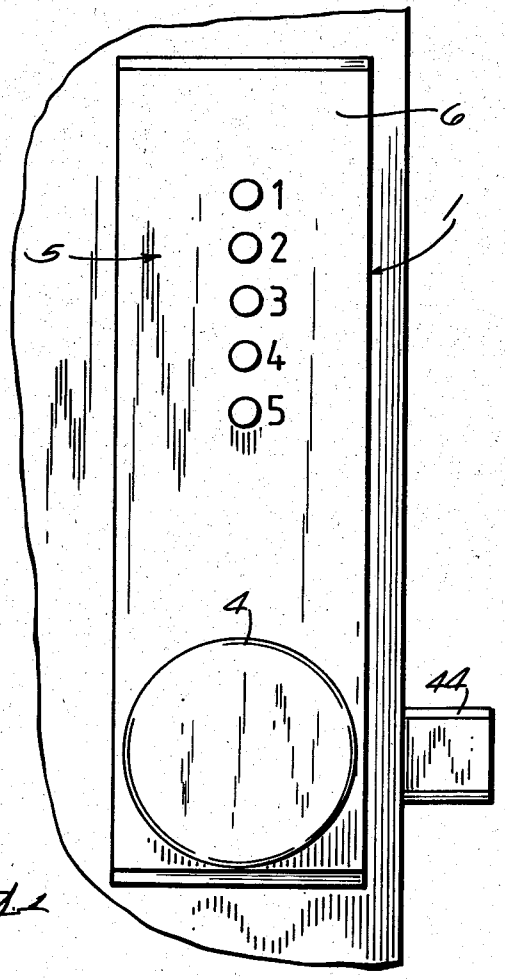
FIG. 2 is a cross section view showing the permutation lock chamber, latch operating means and a clutch with a linkage connected between a control shaft on the lock chamber.

FIG. 2 illustrates a cross section view of the device shown in FIG. 1, with a lock chamber 7 immediately behind the pushbuttons 5 and panel 6. Rotation of the control shaft 8 is controlled by the lock chamber mechanism. A delayed relocking device 9 is positioned in a cavity 10 in the door 2. The time-delay relocking device 9 includes a plunger 11 which extends forwardly into the compartment 12 and interferes with the operation of the linkage 13 and prevents its operation in one direction and operating the latch. The plunger 11 is retracted by the cams 28 and 29 and operates the microswitch to generate a signal when the linkage is operated. The plunger progresses forwardly to an interfering position during a predetermined time interval when the cams are returned to neutral. The microswitch 16 provides terminals for connection through an electrical circuit to a signalling device or remote indicator which will indicate if there is tampering or opening of the lock. The indicator can be positioned at a remote location to provide the owner a means of determining when there is someone attempting to operate the lock. An adjustable knob 17 controls the time interval for operation of the delayed relocking device 9. For the purpose of illustration, the device may be an air control device with a diaphragm and an adjustable orifice controlled by an adjustable knob 17 to control the duration of time for the plunger to move forward to an extended interfering position.

The inner knob 18 on the inside of the door will operate the latch element 44 without use of the permutation lock 1.

The outer knob 4 operates through a drive shaft 19 extending into the clutch 20. A shaft 21 extends into the latch operating mechanism behind the plate 22.

Figure 4:
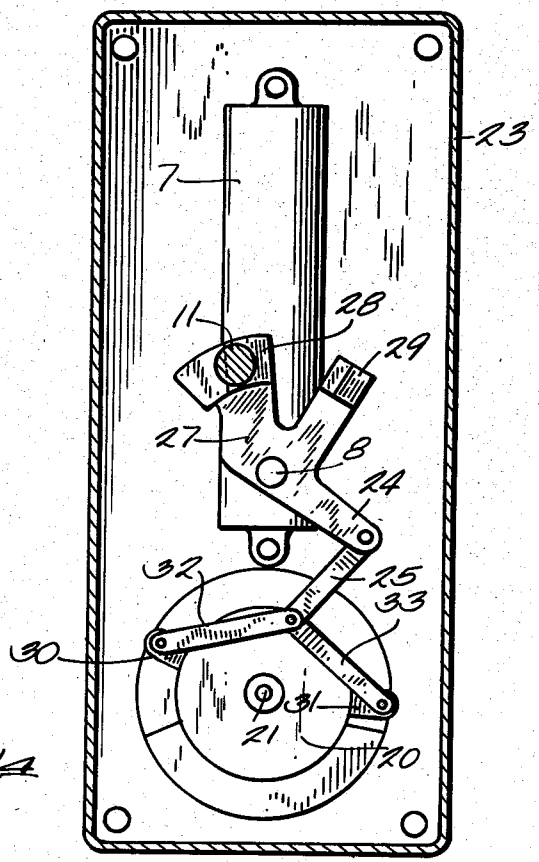
FIG. 4 is a cross section view similar to FIG. 3, showing the position for the linkage for scrambling the code in the lock chamber and resetting the delayed relocking device in the opening mode.
Figure 6:
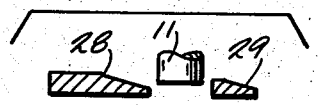
FIG. 6 is a cross section view taken on the plane of the lines 6—6 in FIG. 3, showing the cam surfaces on the linkage.
Figure 3:
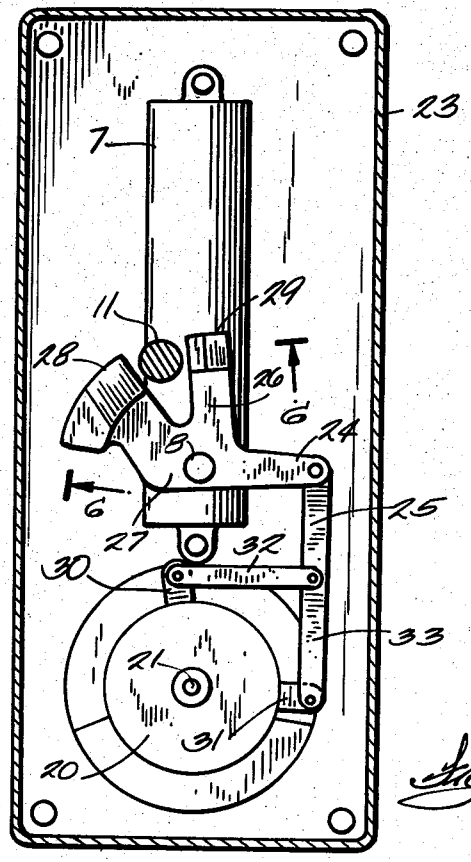
FIG. 3 is a cross section view taken on line 3—3 of FIG. 2, showing the linkage connected between the control shaft on the permutation lock chamber in the neutral position, and the clutch for unlatching the latch element.
Figure 7:
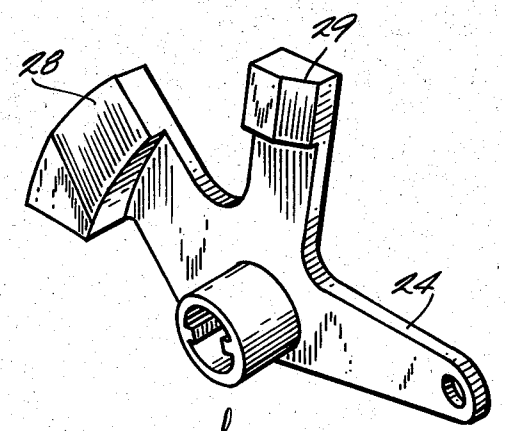
FIG. 7 is a three-dimensional view of the control shaft arm on the lock chamber, showing the cam surfaces for operating the delayed relocking device.
Figure 5:
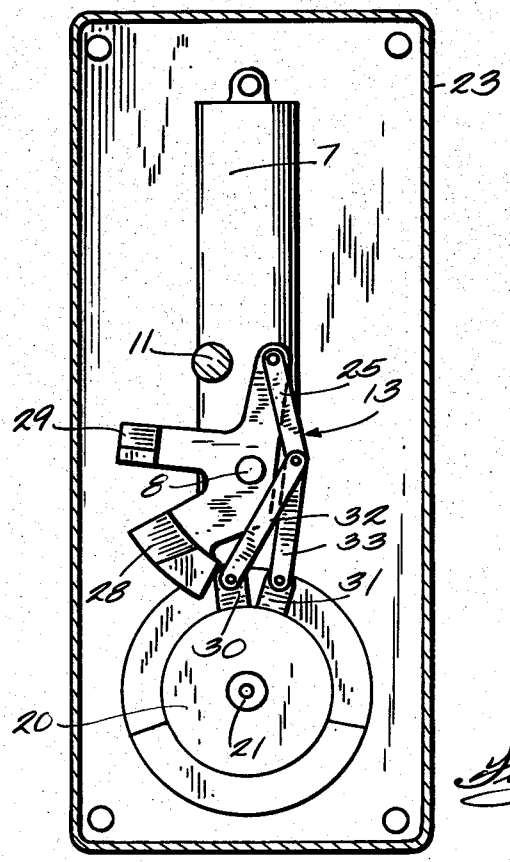
FIG. 5 is a similar view to that of FIG. 3, showing a linkage between the control shaft of the permutation lock chamber and the clutch, for driving the unlatching mechanism to the unlatching position.
Figure 4:
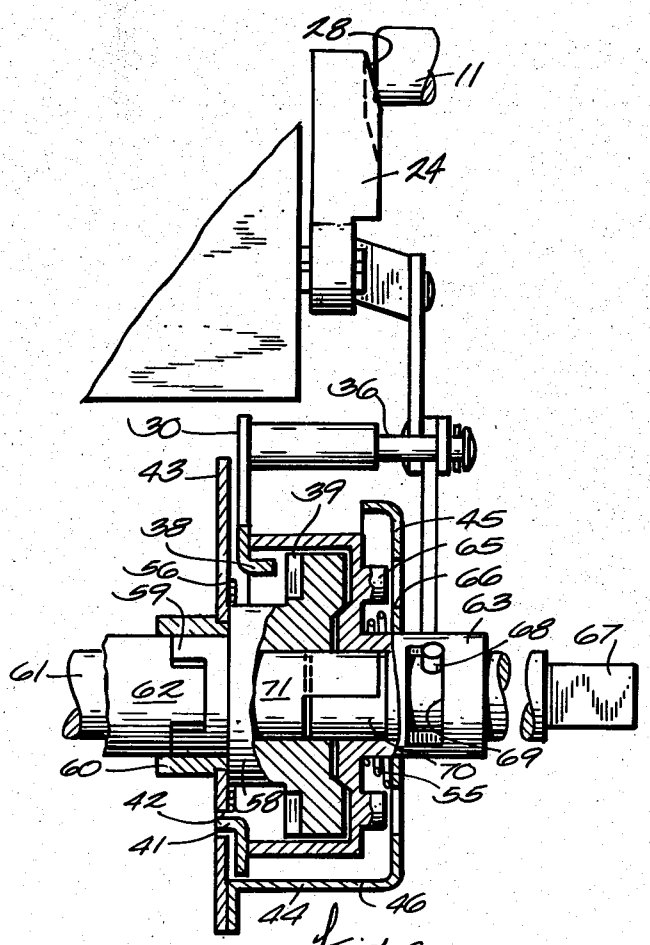
Figure 6:
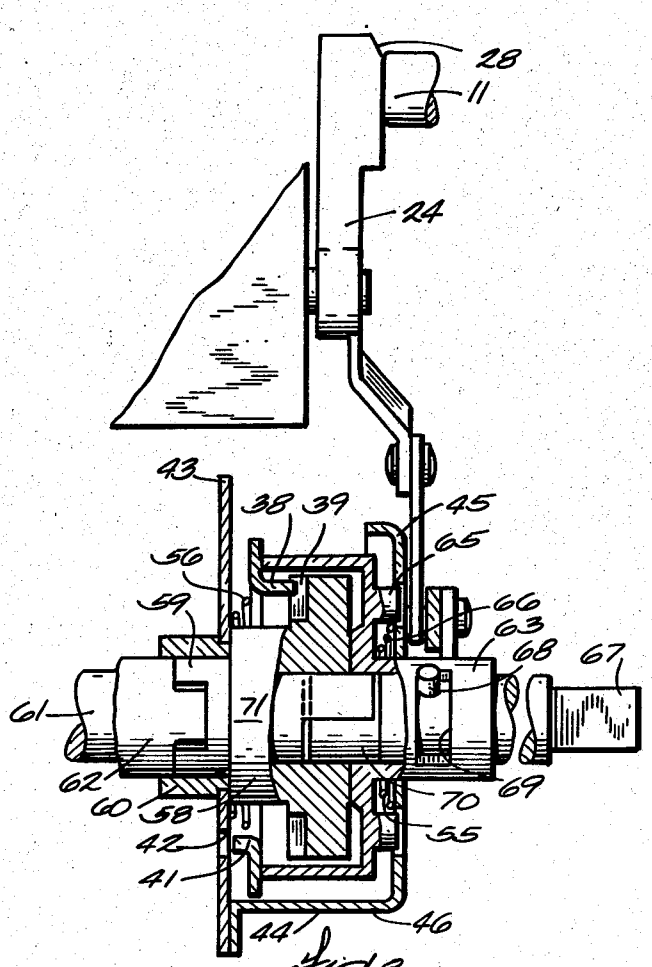
Figure 10:
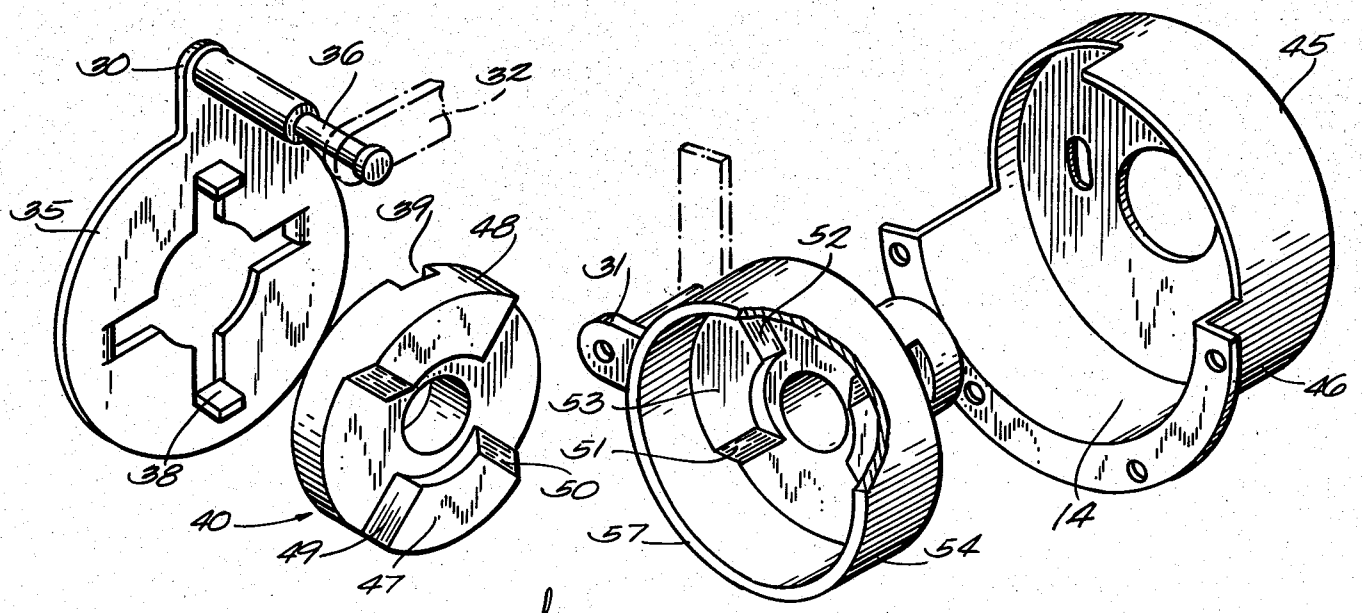
FIG. 10 is an exploded view of the clutch, showing the components in the clutch.

FIG. 3 illustrates the position of the linkage and the control shaft when the latch is in the extended position and the door is latched. The housing 23 encloses the lock chamber 7 and the control shaft 8 is rotated to neutral position, as shown. The control shaft arm 24 extends to the link 25. The control shaft arm 24 also has two cam arms 26 and 27. The cam 28 on cam arm 27 resets the time-delay mechanism when the linkage is operated to scramble the code in the lock chamber 7. The plunger 11 is shown in section and extended to an interfering position with the linkage. The cam 29 operates to reset the time delay mechanism if the linkage has been rotated to its position shown in FIG. 5 and retained in this position long enough for the time delay mechanism to cycle to its extended position;

FIG. 6 illustrates a section view of the cams and the plunger 11;

FIG. 4 illustrates the scrambling or "cancelling" position, and also the reset position for the time delay mechanism. The control shaft arm 24 has been rotated in a clockwise direction, as viewed in FIG. 4 relative to the view in FIG. 3. The reset disc 30 has been rotated in a counterclockwise direction and the linkage has changed position, as indicated. This operation scrambles the coe in the lock chamber 7;

FIG. 5 illustrates the linkage moved to a position for retracting a latch. The linkage has shifted to the position where the clutch actuator disc arm 31 is rotated in a counterclockwise direction. This carries the links 32 and 33 to the position shown. The reset disc arm 30 remains in the fixed position;

To rotate the linkage to this position, normally the cam 29 would interfere with the plunger 11 unless the linkage is rotated in a clockwise direction first allowing the cam 28 to reset the plunger 11 and move it out of the way of the linkage. If the latch mechanism were held in this position for any length of time for the duration of the return cycle of the time delay mechanism, the cam 29 would reset the time delay mechanism when it is rotated in a clockwise direction to the normal latch extended position;

FIG. 8 illustrates the position for resetting or scrambling the code in the lock chamber, while FIG. 9 shows the clutch in the unlatching position;

FIG. 10 illustrates the components of the clutch for transmitting the unlatching force from the outer knob 4 to unlatch the latch 44;

FIG. 10 shows the reset disc 35 integral with a reset disc arm 30 connected through the pin 36 to the link 32. The reset disc 35 is provided with the tabs 38 which drive throught the slots 39 in the cammed clutch disc 40. The reset disc 35 is also provided with the tabs 41 which extend forwardly into the openings 42 on the plate 43 of the housing. The housing also includes the housing member 14 which has an end wall 45 and the cylindrical portion 46.

The cammed clutch disc 40 is formed with protrusions 47 and 48 each having cammed surraces 49 and 50. These cammed surfaces engage mating cam surfaces 51 and 52 on the protrusions 53 in the clutch actuator disc 54. Normally the spring 55 biases the cammed disc 40 in engagement with the clutch actuator disc 54 and the cammed surfaces provide a drive between the two discs. The spring 55 provides a force to overcome the spring 56 and provide the drive. Spring 55 also biases the clutch actuator disc 54 forwardly, causing the surface 57 on the forward ends of the cylindrical portion of the disc to engage the reset disc 35 and bias the reset 35 so that the tabs 41 enter the openings 42 and lock the reset disc to the housing plate 43.

The cammed disc 40 is formed with a hub 58 which extends to an abutting engagement with the plate 43 of the housing. The jaws 59 of the cammed disc 40 extend through an opening in the end plate 43 and rotate within the bearing 60 which is retained in the plate 43. A spindle 61 which may be keyed to the outer knob, extends centrally within the sleeve 62 which is connected to the knob 4. Accordingly, the knob 4 operates the cammed disc 40 and drives the clutch actuator disc 54. The clutch actuator disc is also formed with a hub 63. In the forward position of the latch operating disc, the lugs 65 are held disengaged from the holes 66 in the rear walls 45 of the clutch housing 14.

It will be noted that the latch operating disc 54 has an elongated hub 63 which projects rearwardly therefrom to a central hole in the rear wall 45 of the clutch housing beyond the rear end of spindle 61, to rotatably receive the forward end portion of the latch actuating shaft 67. A pin 68 projects radially from the outside of the shaft and into a notch 69 to establish a driving connection between the operating disc 54 and the latch actuating shaft 67 capable of accommodating rotation of the shaft relative to the latch operating disc through an angle of 90°. Such relative rotation is necessary at times when the spindle 61 is drivingly connected to a key-override mechanism in the outer knob 4, as for example, a pin tumbler lock which has an operating stroke of 180°. In that case, the forward end of the latch actuating shaft 67 is half cut away to provide a flat drive abutment 70 lying in a plane containing the shaft axis. A drive lug 71 on the rear end of the spindle 61 is then so located with respect to the abutment 70 as to enable the spindle to rotate 90° in the clockwise direction, as viewed from the knob 4, before it comes into driving relation with the shaft abutment 70 and rotates the latter the next 90° relative to the latch operating disc 54. The latch operating shaft 67 is provided with a square end for operating the latch in the door.

Normally the latch is operated from the outside knob 4 which drives the cammed disc 40 and through the cam surfaces engaging the mating cam surfaces on the clutch operating disc 54. If there is no interference of the linkage 13, the drive normally retracts the latch for opening of the door, When, however, there is interference with the linkage 13, the cammed drive disc 40 rotates relative to the clutch operating disc 54 and forces the clutch operating disc 54 rearwardly. This causes the abutment 65 to extend into the opening 66 and lock the clutch operating disc 54. With a rearward movement of the clutch operating disc 54, the spring 56 biases the reset disc 35 forwardly until the tabs 38 engage the slots 39 in the forward end of the cammed drive disc 40. Accordingly, then the reset disc 35 is rotated to the position shown in FIG. 4, and the control shaft 8 is rotated and the chamber lock is scrambled.

The device operates in the following manner:

The outside knob 4 is rotated to retract the latch. Rotation of the knob 4 in a clockwise direction causes the linkage 13 to operate. Since the plunger 11 of the time delay mechanism extends into the path of motion of the cams 28 and 29, it interferes with the movement of the linkage. This, in turn, causes the cammed drive disc 40 to rotate relative to the clutch actuator disc 54 and drive the clutch actuator disc 54 rearwardly so that the lugs 65 move rearwardly into the opening 66 of end wall 45 and lock the clutch actuating disc 54 in a stationary position. The rearward movement of the clutch actuating cam 54 allows the spring 56 to bias the reset disc 35 rearwardly, unseating the tabs 41 from the openings 42 in the plate 43 of the clutch housing. This, in turn, permits the reset disc 35 to be rotated by the cammed drive disc 40 and operate the linkage. The linkage operates the control shaft 8 and scrambles or cancels any code that may remain in the lock chamber. Release of the knob will allow it to rotate counterclockwise. Counterclockwise rotation to return the knob 4 to its original retracted position is caused by the springs 80 engaging the pin 81 in the shaft 82. The shaft 82 rotates counterclockwise until the pin 81 returns to a rest position against the stop 83 which is fastened to the panel 6 of the chamber housing.

Rotation of the knob 4 and the linkage in the manner described also provides another function in that the cam 28 on the control shaft arm 24 biases the plunger 11 rearwardly, moving the plunger out of the path of the linkage or cams 28 and 29. The plunger will remain in a retracted position for a predetermined duration of time. The duration of time is adjustable by an adjustable knob on the adjustment 17.

When the code is then applied to the buttons 5 on the panel 6, the knob 4 is again rotated and, because there is no interference with the movement of the linkage due to shaft 8, the knob wil rotate cammed drive disc 40 which will carry the clutch operating disc 54. Movement of the clutch operating disc 54 will drive the pin 68 and shaft 67 and retract the latch. The lock chamber, being decoded, allows shaft 8 to rotate in the opposite direction which carries the arm 31 of the latch actuating disc 54. Accordingly, the latch is retracted and the linkage swings to the position shown in FIG. 5 and, in this position, the latch is retracted and the chamber code will be cancelled when it returns to its former position, as shown in FIG. 3.

When the knob 4 is allowed to rotate counterclockwise, the linkage will return to the position shown in FIG. 3 and the code will be cancelled from the permutation lock chamber.

Adjustment of the adjustor 17 will control the duration of time of the delayed relocking device. The time may be shortened or extended, as desired. The microswitch 16 is also provided with an electrical circuit to the remote indicator which will indicate to the personnel at a remote location that an attempt has been made to open the door, or that the door has been opened.

The embodiments of the invention in which an exclusive property or privilege is claimed are defined as follows:

1. A latching means comprising:

a permutation lock having a latch element;

a control element releasable for motion in one direction from a normal position responsive to proper decoding of the permutation lock;

a first rotatable clutch member connected to said latch element for retracting said latch element in response to rotation of said clutch member in one direction;

a second rotatable clutch member for transmitting such latch retracting rotation through said clutch member;

drive means providing a rotation transmitting connection between said clutch members which is disruptable upon movement of one of said member to an inactive position in a predetermined direction along an axis of rotation relative to the other clutch member;

connecting means connecting said control element with said first clutch member whereby rotary latch retracting motion of the latter is interfered with, except when the permutation lock has been properly decoded, said drive means on said clutch members rendered ineffective by such interference with latch retracting rotation of the clutch member to move said member relative to the other to an inactive position;

a delayed relocking device having a retracted lock opening mode and an extended lock closed mode, said connecting means normally biasing said delayed relocking device to a retracted position when moving in one direction, means in said delayed relocking device biasing said device to an extended position in a predetermined time, said delayed relocking device in the extended position interfering with movement of said linkage means in a second direction and causing said first clutch member to move relative to the other to its said inactive position, except for a predetermined time from the setting of the opening mode of said delayed relocking device.

2. A locking means comprising:

a permutation lock controlling retraction of a latch element;

a rotatable drive member;

a control element on the permutation lock releasable for motion in one direction out of a neutral position after proper decoding of the permutation lock and movable in the opposite direction from a neutral position at the other times to effect resetting of the permutation lock;

a first rotatable clutch member driven by said rotatable drive member to effect retraction of said latch element;

drive means between said members allowing relative movement between said members to provide active drive or drive interruption;

linkage means connecting the control element with said clutch member so that the rotation thereof is interfered with except upon proper decoding of the permutation lock mechanism;

said drive means on said members rendered ineffective at times when rotation of the clutch member is thus interfered with, for axial relative movement of said members to their said inactive positions;

a second clutch element connected through said linkage means with said control element;

means providing drive connection between the second clutch element and the drive member effective only in said inactive position of said first clutch member to translate said latch releasing rotation of the drive member into motion of the control element in said opposite direction to effect resetting of the permutation lock member;

a time delayed relocking device having means selectively interfering with said linkage means and drive between the drive and first clutch member; and means normally biasing said device to an interfering position with said linkage means in a predetermined time of duration;

manual means on said linkage means for biasing said device from an interfering position with said linkage means, said device thereby interrupting drive for retraction of said latch when said delayed relocking device is in the extended interfering position.

3. A locking means comprising:

a permuation lock controlling retraction of a latch element;

a rotary drive member;

a control element on the permutation lock releasable for motion in one direction out of a neutral position after proper decoding of the permutation lock and movable in the opposite direction from the neutral position at times to effect resetting of the permutation lock;

a first rotatable clutch member driven by said rotatable drive member to effect retraction of said latch element;

linkage means connecting the control element with said clutch member so that the rotation thereof is interfered with except upon proper decoding of the permutation lock mechanism;

drive means between said members allowing transient relative movement between said members to provide active drive or interrupted drive;

said drive means on said members rendered ineffective at times when rotation of the clutch member is thus interfered with for moving said members to their interrupted drive position;

a second clutch member connected by said linkage means to the control element;

means providing driving connection between the second clutch member and drive member effective only in said interrupted position of said drive and first clutch members to translate said latch releasing rotation of the drive member into motion of the control element in said opposite direction to effect resetting of the permutation lock;

a delayed relocking device including biasing means normally biasing an element to an interfering position with said linkage means;

a cam member on said linkage means selectively engaging said device for biasing said element to a non-interfering position when said linkage is operated, said biasing means biasing said element of said delayed relocking device to an interfering position after a predetermined time subsequent to decoding of said lock to thereby prevent the unlocking of said permutation lock even when the permutation lock is decoded.

4. A locking means as set forth in claim 1, wherein said means connecting said control element with said clutch member defines a linkage, and said delayed relocking device includes a plunger reciprocating between a linkage interfering and non-interfering position.

5. A locking means as set forth in claim 1, wherein said means connecting said control element of said first clutch member defines a linkage, said linkage includes at least one cam, said delayed relocking device includes a plunger reciprocating between an interfering and a non-interfering position with said linkage, said cam operating to bias said plunger to a non-interfering position with said linkage to allow decoding of said lock chamber.

6. A locking means as set forth in claim 2, wherein said delayed relocking device includes a reciprocating plunger, said means connecting said control element with said clutch member includes a linkage defining a path of motion interfering with the path of motion of said reciprocating plunger, whereby interference between said plunger and linkage prevents operation or retraction of said latch element.

7. A locking means as set forth in claim 1, wherein said control element includes a rotating shaft, said means connecting said control element with said clutch member defines a linkage, said linkage allowing rotation and counterrotation of said control shaft responsive to interference between said delayed relocking device and said linkage.

8. A locking means as set forth in claim 2, wherein said means connecting said control element and said clutch member defines a linkage including a pair of cams, said delayed relocking device includes a member moving into and out of the path of motion of said linkage, said cams biasing said member of said delayed relocking device to a non-interfering position with said linkage to allow operation of said linkage and operation of said lock.

9. A locking means as set forth in claim 3, wherein said delayed relocking device includes a reciprocating element normally in an interfering position.

10. A locking means as set forth in claim 2, wherein said control element defines a control shaft, said means connecting said control element with said clutch member defines a linkage, said first clutch member defines a clutch actuating member including an arm connected to said linkage, said second clutch member includes a clutch reset disc having an arm connected to said linkage, said linkage selectively and alternatively operated by said clutch actuating member and said reset clutch disc member responsive to interference and non-interference with operation of said linkage.

* * * * *